US011338412B2

(12) United States Patent
Chung

(10) Patent No.: US 11,338,412 B2
(45) Date of Patent: May 24, 2022

(54) DIRECTION CONTROLLER FOR A RATCHET SCREW DRIVER

(71) Applicant: CENDAI INDUSTRIAL CO., LTD., Taichung (TW)

(72) Inventor: Hui-Hsueh Chung, Taichung (TW)

(73) Assignee: CENDAI INDUSTRIAL CO., LTD., Taichung (TW)

( * ) Notice: Subject to any disclaimer, the term of this patent is extended or adjusted under 35 U.S.C. 154(b) by 306 days.

(21) Appl. No.: 16/719,946

(22) Filed: Dec. 18, 2019

(65) Prior Publication Data

US 2021/0187705 A1 Jun. 24, 2021

(51) Int. Cl.
*B25B 15/04* (2006.01)
*B25B 23/00* (2006.01)

(52) U.S. Cl.
CPC ..... *B25B 15/04* (2013.01); *B25B 23/0007* (2013.01)

(58) Field of Classification Search
CPC .... B25B 15/04; B25B 23/0007; B25B 13/463
USPC ..... 81/60
See application file for complete search history.

(56) References Cited

U.S. PATENT DOCUMENTS 5,685,204 A * 11/1997 Braun ..... B25B 13/463 81/60
5,687,820 A * 11/1997 Lin ..... B25B 13/463 192/43.2
5,974,915 A * 11/1999 Chou ..... B25B 13/463 192/43.2
6,644,147 B1 * 11/2003 Huang ..... B25B 13/463 192/43.2

* cited by examiner

*Primary Examiner* — Hadi Shakeri
(74) *Attorney, Agent, or Firm* — Bruce Stone LLP; Joseph A. Bruce

(57) ABSTRACT

A ratchet screw driver includes a holder, a toothed wheel, two pawls, a direction switch and a ring. The toothed wheel, the pawls and the ring are inserted in the holder. The pawls are biased from each other. Each of the pawls includes a boss and a toothed face. The direction switch is connected to the holder, movable between two positions relative to the holder, and formed with two bosses. The ring includes two cutouts and two hooks. The cutouts receive the bosses so that the ring is rotatable with the direction switch. One of the hooks is engaged with the boss of one of the pawls to firmly engage the toothed face of the remaining one of the pawls with the toothed wheel when the ring is moved to one of the positions by the direction switch.

7 Claims, 8 Drawing Sheets

DIRECTION CONTROLLER FOR A RATCHET SCREW DRIVER

BACKGROUND OF INVENTION

1. Field of Invention

The present invention relates to a ratchet screw driver and, more particularly, to a direction controller for a ratchet screw driver.

2. Related Prior Art

A conventional screw driver includes a handle and a shank. The shank includes an end inserted in a handle and at another end located out of the handle and used as an operative portion. The operative portion is a cruciform or flat portion to be inserted in a corresponding recess made in a head of a screw. Thus, the handle is operable to rotate the shank so that the operative portion of the shank rotates the screw. The screw is always rotated in a same direction as the handle.

Taiwanese Patent No. 155344 discloses a ratchet screw driver including a bit 1, an axle 2, a switch 3, a socket 4 and a handle 5. The bit 1 includes a space 12 in communication with two slots 13 and 15. A pawl 14 formed with two toothed portions (not numbered) is inserted in the slot 13. The pawl 14 is pivotally connected to the bit 1 by a pin 141. A spring 22 includes an end connected to the axle 2 and another end abutted against a ball 23. The axle 2 is inserted in the space 12 so that the ball 23 is kept in contact with the pawl 14 by the spring 22. The bit 1 is inserted in the socket 4. One of the toothed portions of the pawl 14 is engaged with a toothed face of the socket 4. The handle 5 is connected to the socket 4 so that they are rotatable together. The switch 3 is in the form of a ring with a flange 33 inserted in a groove (not numbered) made in an internal face of the socket 4 so that the switch 3 is rotationally connected to the socket 4. The switch 3 is operable to bring one of the toothed portions of the pawl 141 into contact with the toothed face 41 of the socket 4.

The present invention is therefore intended to obviate or at least alleviate the problems encountered in prior art.

SUMMARY OF INVENTION

It is the primary objective of the present invention to provide a reliable ratchet screw driver.

To achieve the foregoing objective, the ratchet screw driver includes a holder, a toothed wheel, two pawls, a direction switch and a ring. The toothed wheel is inserted in a wheel chamber of the holder. The pawls are inserted in a pawl chamber of the holder and biased from each other. Each of the pawls includes a boss and a toothed face. The direction switch is connected to the holder to cover the ring chamber, movable between two positions relative to the holder, and formed with two bosses. The ring is inserted in a ring chamber of the holder and includes two cutouts and two hooks. The cutouts receive the bosses so that the ring is rotatable with the direction switch. One of the hooks is engaged with the boss of one of the pawls to firmly engage the toothed face of the remaining one of the pawls with the toothed wheel when the ring is moved to one of the positions by the direction switch.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Figure 1:
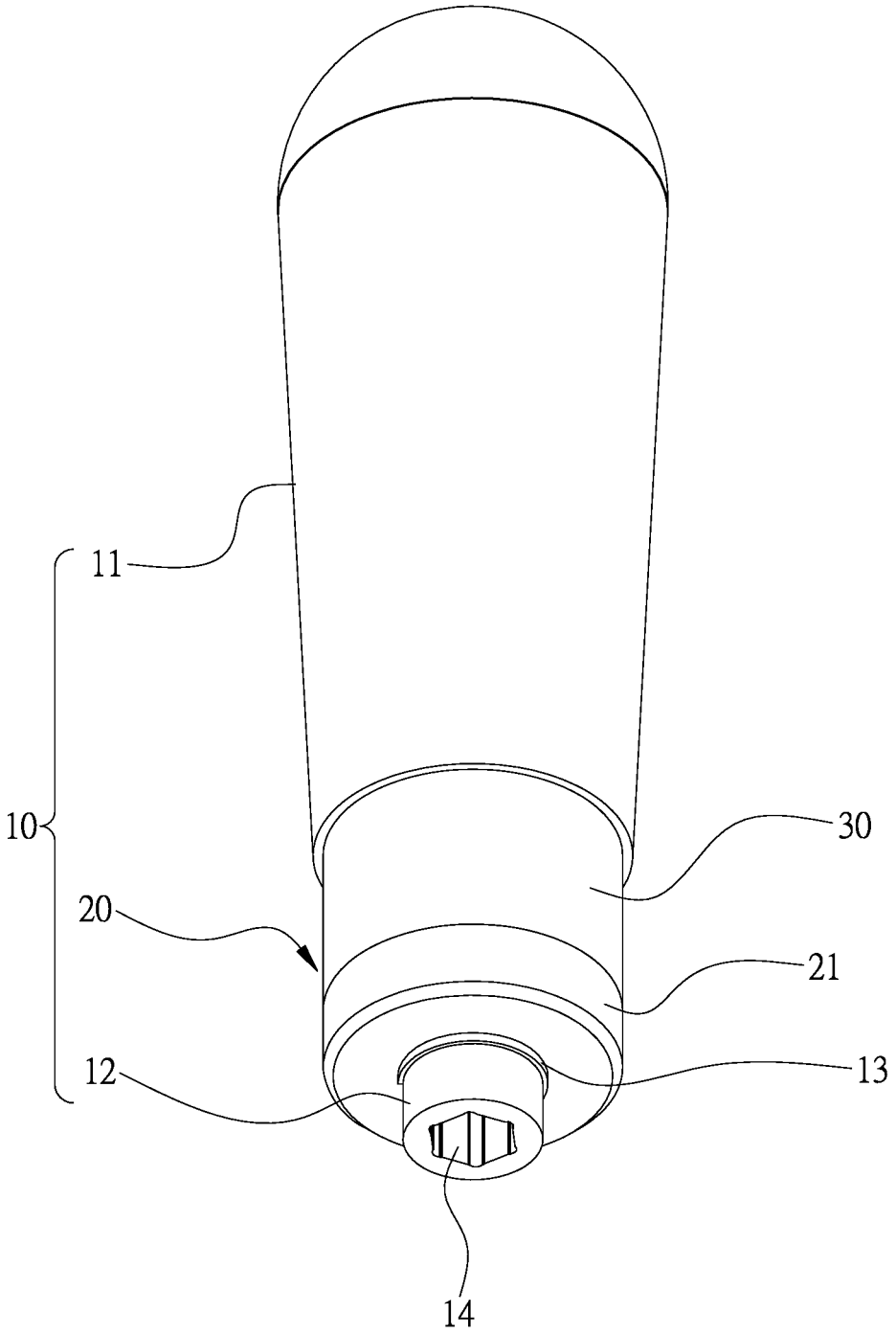
FIG. 1 is a perspective view of a ratchet screw driver according to the first embodiment of the present invention.
Figure 2:
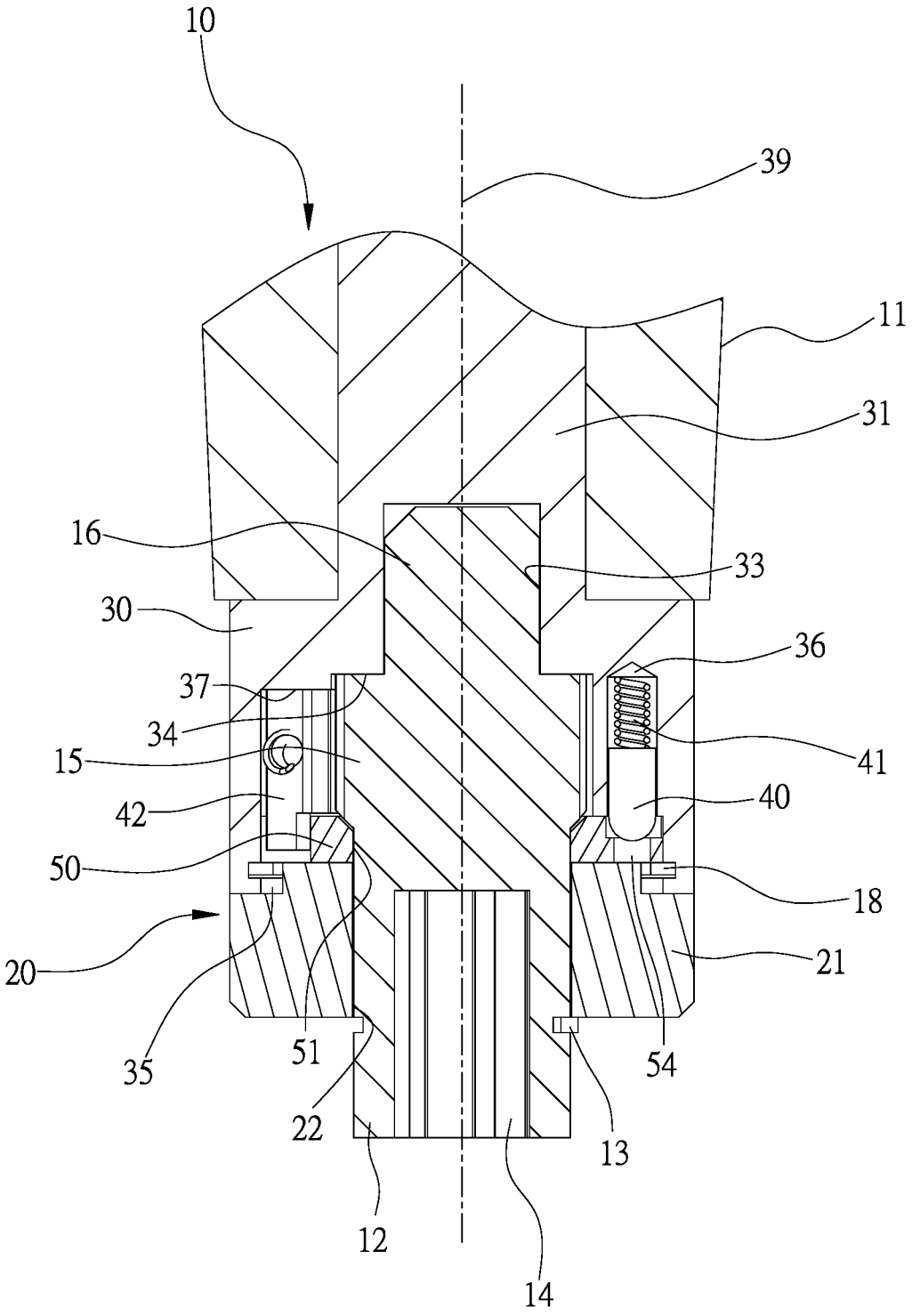
FIG. 2 is a partial and cross-sectional view of the ratchet screw driver shown in FIG. 1.
Figure 3:
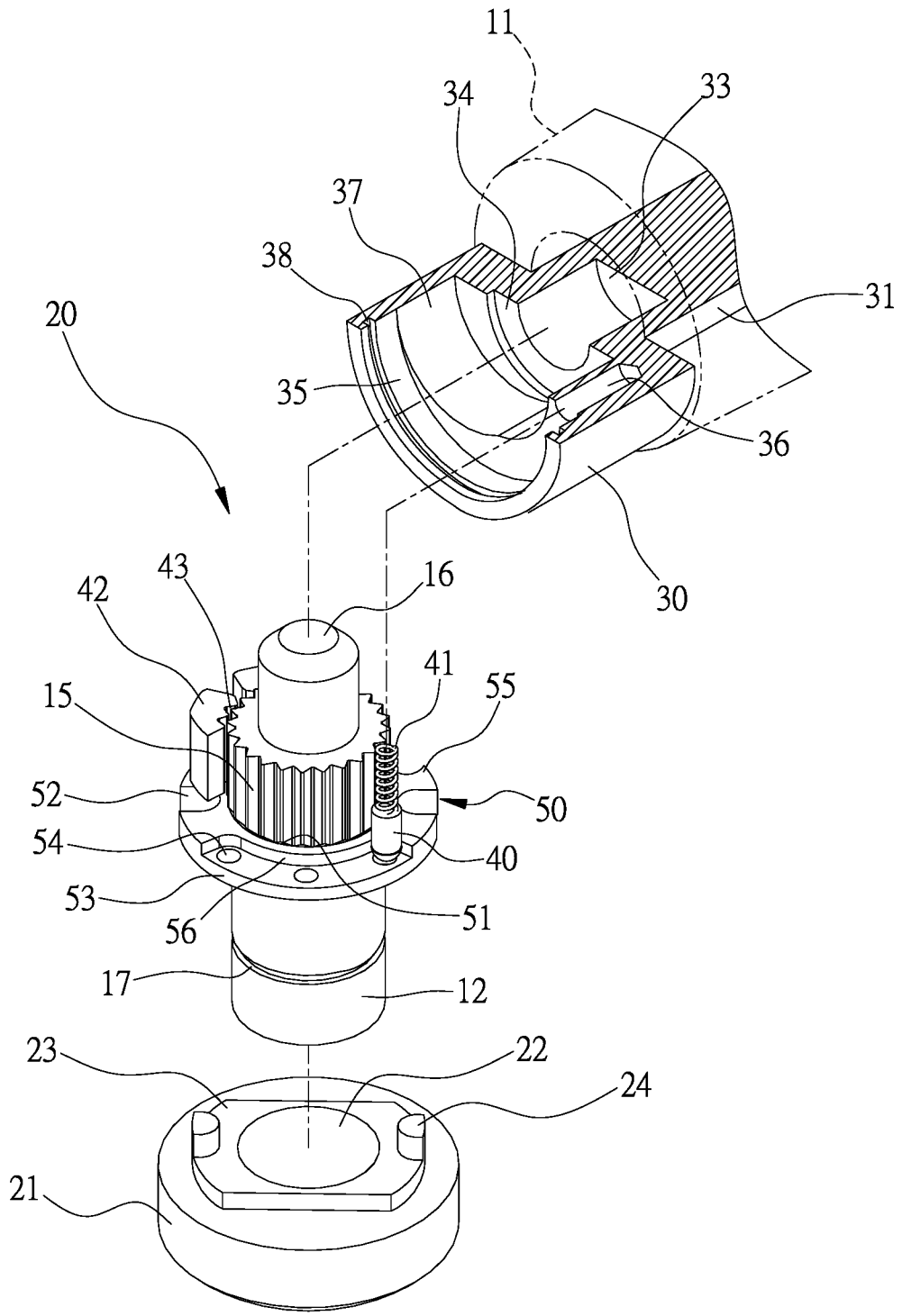
FIG. 3 is a partial and exploded view of the ratchet screw driver shown in FIG. 1.
Figure 4:
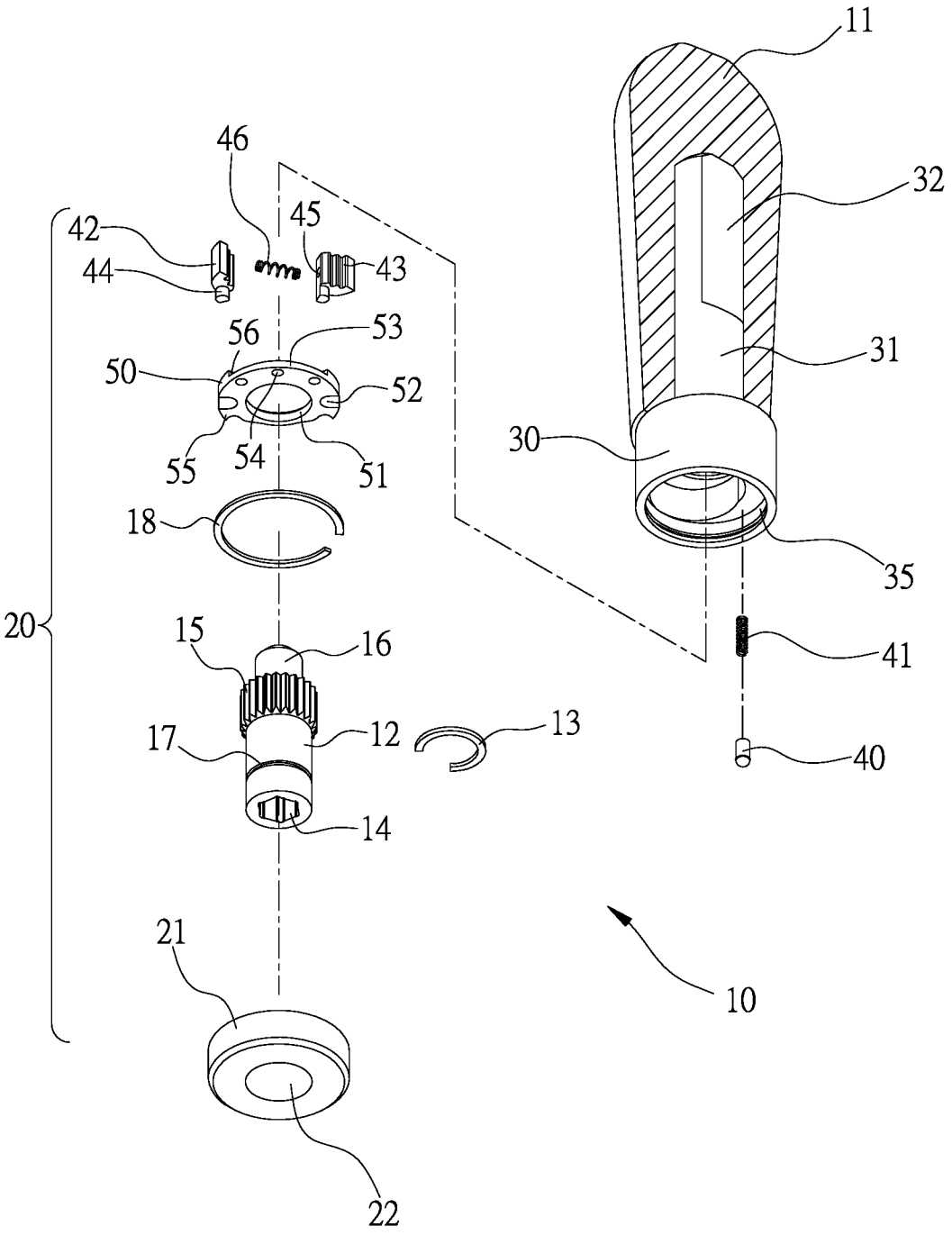
FIG. 4 is an exploded view of the ratchet screw driver shown in FIG. 1.

Referring to FIGS. 1 to 4, a ratchet screw driver 10 includes a handle 11, a shank 12 and a direction controller 20 according to a first embodiment of the present invention. The direction controller 20 connects the handle 11 to the shank 12. The shank 12 can be engaged with a screw, a threaded bolt or a nut. Thus, a user can operate the handle 11 to rotate the shank 12 via the direction controller 20 to drive a screw, a threaded bolt or a nut.

In the first embodiment, the shank 12 includes a socket 14, a toothed wheel 15, an axle 16 and a groove 17. The socket 14 is formed at a lower end of the shank 12. The axle 16 is formed at an upper end of the shank 12. The toothed wheel 15 is formed between the socket 14 and the axle 16. The groove 17 is made in the periphery of the shank 12, in the vicinity of the lower end of the shank 12.

In another embodiment, the shank 12 can include a polygonal portion (not shown) instead of the socket 14. The polygonal portion can be inserted in a corresponding cavity made in a socket (not shown). The socket includes another cavity for receiving a bit.

The direction controller 20 includes a direction switch 21, a holder 30, a positioning element 40, two pawls 42 and a ring 50. The direction switch 21 is in the form of a ring including an axial bore 22, a platform 23 and two bosses 24. The platform 23 is formed on an upper face of the switch 21. The axial bore 22 extends throughout the switch 21 including the platform 23. The bosses 24 are formed on an upper face of the platform 23. The axial bore 22 is located between the bosses 24. The bosses 24 can be hemi-circular or circular bosses.

The holder 30 is formed with an extensive portion 31, a flat portion 32, an axle chamber 33, a wheel chamber 34, a ring chamber 35, a cavity 36 and a pawl chamber 37. The extensive portion 31 extends from an upper face of the holder 30. The flat portion 32 extends from an upper end of the extensive portion 31.

The axle chamber 33, the wheel chamber 34, the ring chamber 35, the cavity 36 and the pawl chamber 37 are made in a lower face of the holder 30. The axle chamber 33, the wheel chamber 34 and the ring chamber 35 are circular chambers arranged in sequence along an axis 39, i.e., they are coaxial with one another. The cavity 36 is a circular cavity in the vicinity of the ring chamber 35. The cavity 36 is not in communication with the ring chamber 35. The pawl chamber 37 is a crescent chamber in communication with the ring chamber 35 in a radial direction. A groove 38 is made in a wall of the ring chamber 35.

Each of the pawls 42 includes a toothed face 43 formed on an internal side, an arched face (not numbered) formed on an external side, a boss 44 extending from a lower face, and a cavity 45 made in another side. A spring 46 is formed with two ends. Each of the ends of the spring 46 is fitted in the cavity 45 of each of the pawls 42. Thus, the spring 46 interconnect the pawls 42. In operation, the spring 46 is compressed between the pawls 42, i.e., the pawls 42 are biased from each other by the spring 46.

The ring 50 includes a circular opening 51, two cutouts 52, a thickness-reduced portion 53, three positioning recesses 54, two hooks 55 and a wall 56. The circular opening 51 is located at a center of the ring 50. The cutouts 52 are located at two ends of a diameter of the ring 50. The thickness-reduced portion 53 is made by cutting an arched groove in an upper face of the ring 50. The wall 56 extends along the thickness-reduced portion 53 of the ring 50. The wall 56 includes two bent terminal portions that can be deemed to be two closed ends of the arched groove that shapes the thickness-reduced portion 53 of the ring 50. The positioning recesses 54 are made in the thickness-reduced portion 53 of the ring 50. Each of the positioning recesses 54 is an aperture, i.e., it includes an open upper end and an open lower end. The hooks 55 are formed by cutting an arched portion from the edge of the ring 50.

In assembly, the flat portion 32 and the extensive portion 31 of the holder 30 are inserted in the handle 11 so that the holder 30 is rotatable with the handle 11.

The positioning element 40 is in the form of a pin. The positioning element 40 is inserted in the cavity 36 after a spring 41 is inserted in the cavity 36. The positioning element 40 is biased by the spring 41. The pawls 42 and the spring 46 are inserted in the pawl chamber 37.

The axle 16 is inserted in the axle chamber 33. The toothed wheel 15 is inserted in the wheel chamber 34. The toothed wheel 15 is engaged with the teethed face 43 of at least one of the pawls 42.

The ring 50 is inserted in the ring chamber 35. A lower portion of the shank 12 extends throughout the ring 50. A shoulder formed between the toothed wheel 15 and the lower portion of the shank 12 is in contact with the ring 50.

The bosses 44 of the pawls 42 are movable between the hooks 55. The positioning element 40, which is biased by the spring 41, can be partially inserted in one of the positioning recesses 54 of the ring 50 to keep the ring 50 in one of three positions relative to the holder 30. The movement of the positioning element 40 is confined between the bent portions of the wall 56. Thus, the rotation of the ring 50 relative to the holder 30 is kept in a range.

A C-clip 18 is inserted in the groove 38 of the holder 30. The C-clip 18 is abutted against the ring 50. Thus, the ring 50, the positioning element 40, the spring 41, the pawls 42 and the spring 46 are kept in the holder 30.

The direction switch 21 is rotationally located on and around the lower portion of the shank 12, i.e., the lower portion of the shank 12 extends throughout the axial bore 22 of the direction switch 21. The platform 23 is abutted against the ring 50. The bosses 24 are inserted in the cutouts 52 so that the direction switch 21 is rotatable with the ring 50.

A C-clip 13 is located beneath the direction switch 21. The C-clip 13 is inserted in the groove 17 of the shank 12. The clip 13 is abutted against the direction switch 21 to keep the direction switch 21 on the shank 12.

In operation, the socket 14 is used to receive a bit (not shown). The handle 11 is operated to rotate the holder 30. The holder 30 rotates the shank 12 via at least one of the pawls 42. The shank 12 rotates the bit.

Figure 5:
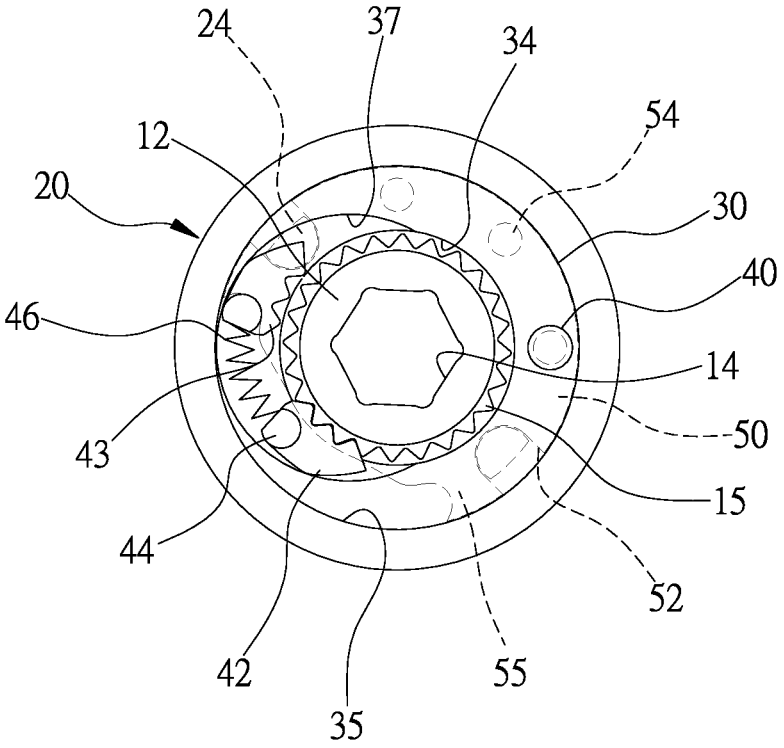
FIG. 5 is another cross-sectional view of the ratchet screw driver shown in FIG. 1.

Referring to FIG. 5, the direction switch 21 is operable to move the ring 50 to one of the positions due to the insertion of the bosses 24 in the cutouts 52. The positioning element 40 is inserted in one of the positioning recesses 54 to keep the ring 50 in position. One of the hooks 55 is engaged with the boss 44 of one of the pawls 42 (the "first pawl 42") to engage the toothed face 43 of the other pawl 42 (the "second pawl 42") with the toothed wheel 15 of the shank 12. The arched face of the second pawl 42 is in contact with an arched wall of the pawl chamber 37. Thus, the second pawl 42 is jammed between the toothed wheel 15 of the shank 12 and the arched wall of the pawl chamber 37.

The handle 11 can be rotated to rotate the holder 30 clockwise. The holder 30 rotates the shank 12 clockwise via the second pawl 42 since the arched wall of the pawl chamber 37 abuts against the arched face of the second pawl 42 and hence firmly engages the toothed face 43 of the second pawl 42 with the toothed wheel 15 of the shank 12.

The handle 11 can be operated to rotate the holder 30 counterclockwise. The holder 30 cannot rotate the shank 12 counterclockwise via the second pawl 42 since the arched wall of the pawl chamber 37 leaves the arched face of the second pawl 42 and hence allows the toothed face 43 of the second pawl 42 to disengage from the toothed wheel 15 of the shank 12.

Figure 6:
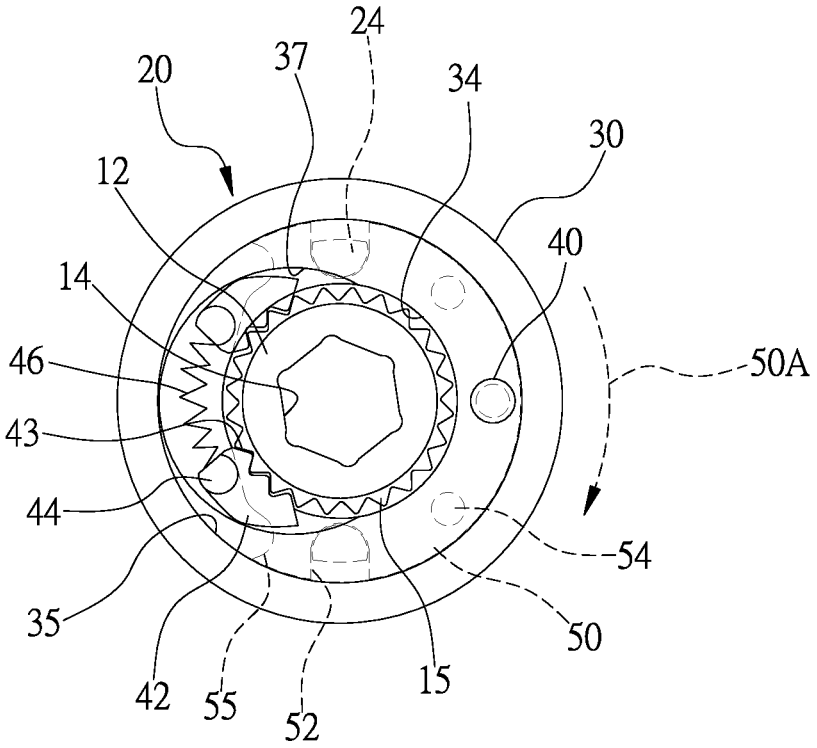
FIG. 6 is a cross-sectional view of the ratchet screw driver in another position than shown in FIG. 5.

Referring to FIG. 6, the direction switch 21 is operable to move the ring 50 to another one of the positions as indicated by an arrow head 50A. The spring positioning element 40 is inserted in another one of the positioning recesses 54 to keep the ring 50 in position.

None of the hooks 55 is engaged with the boss 44 of the first or second pawl 42. Hence, the first and second pawls 42 are moved away from each other by the spring 46 so that the toothed faces 43 of both the first and second pawls 42 are engaged with the toothed wheel 15 of the shank 12. Hence, the shank 12 is not rotatable relative to the holder 30, i.e., they are rotatable together.

The handle 11 can be rotated to rotate the holder 30 clockwise or counterclockwise. The holder 30 rotates the shank 12 clockwise or counterclockwise via the second pawl 42 since the arched wall of the pawl chamber 37 abuts against the arched faces of the first and second pawls 42 and hence firmly engages the toothed faces 43 of both the first and second pawls 42 with the toothed wheel 15 of the shank 12.

Figure 7:
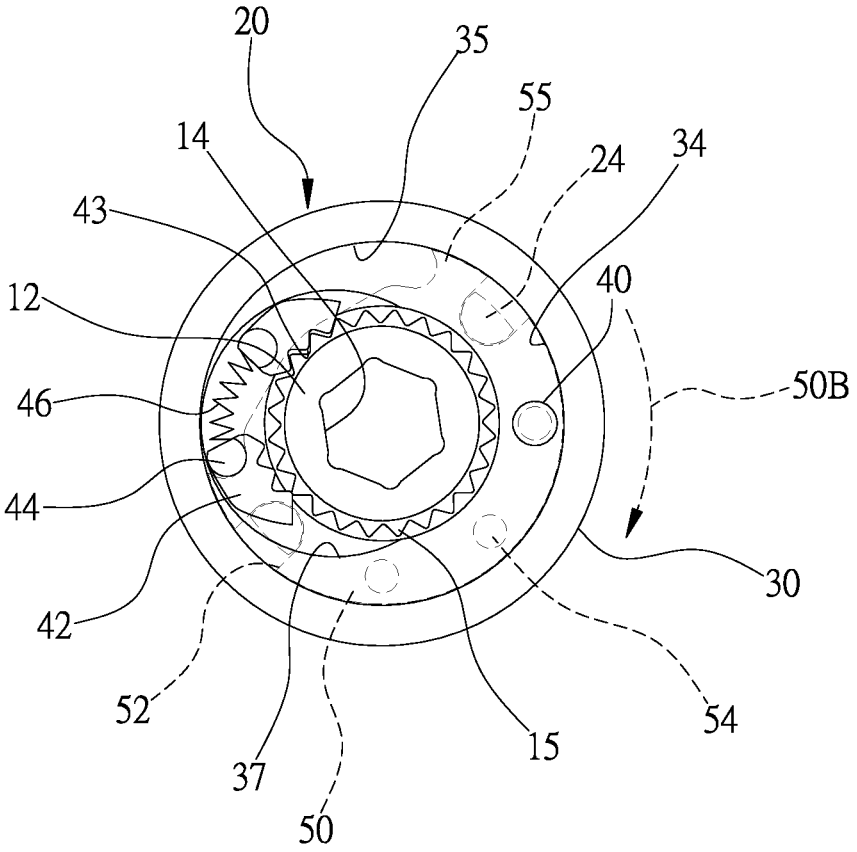
FIG. 7 is a cross-sectional view of the ratchet screw driver in another position than shown in FIG. 6.

Referring to FIG. 7, the ring 50 is operated to rotate the direction switch 21 to the remaining one of the positions as indicated by an arrow head 50B. The remaining one of the hooks 55 is engaged with the boss 44 of the second pawl 42 to engage the toothed face 43 of the first pawl 42 with the toothed wheel 15 of the shank 12. The arched face of the first pawl 42 is in contact with the arched wall of the pawl chamber 37. Thus, the first pawl 42 is jammed between the toothed wheel 15 of the shank 12 and the arched wall of the pawl chamber 37 of the holder 30.

The handle 11 can be rotated to rotate the holder 30 counterclockwise. The holder 30 rotates the shank 12 counterclockwise through the first pawl 42 because the arched wall of the pawl chamber 37 abuts against the arched face of the first pawl 42 and hence firmly engages the toothed face 43 of the first pawl 42 with the toothed wheel 15 of the shank 12.

The handle 11 can be operated to rotate the holder 30 clockwise. The holder 30 cannot rotate the shank 12 clockwise via the first pawl 42 since the arched wall of the pawl chamber 37 leaves the arched face of the first pawl 42 and hence allows the toothed face 43 of the first pawl 42 to disengage from the toothed wheel 15 of the shank 12.

Figure 8:
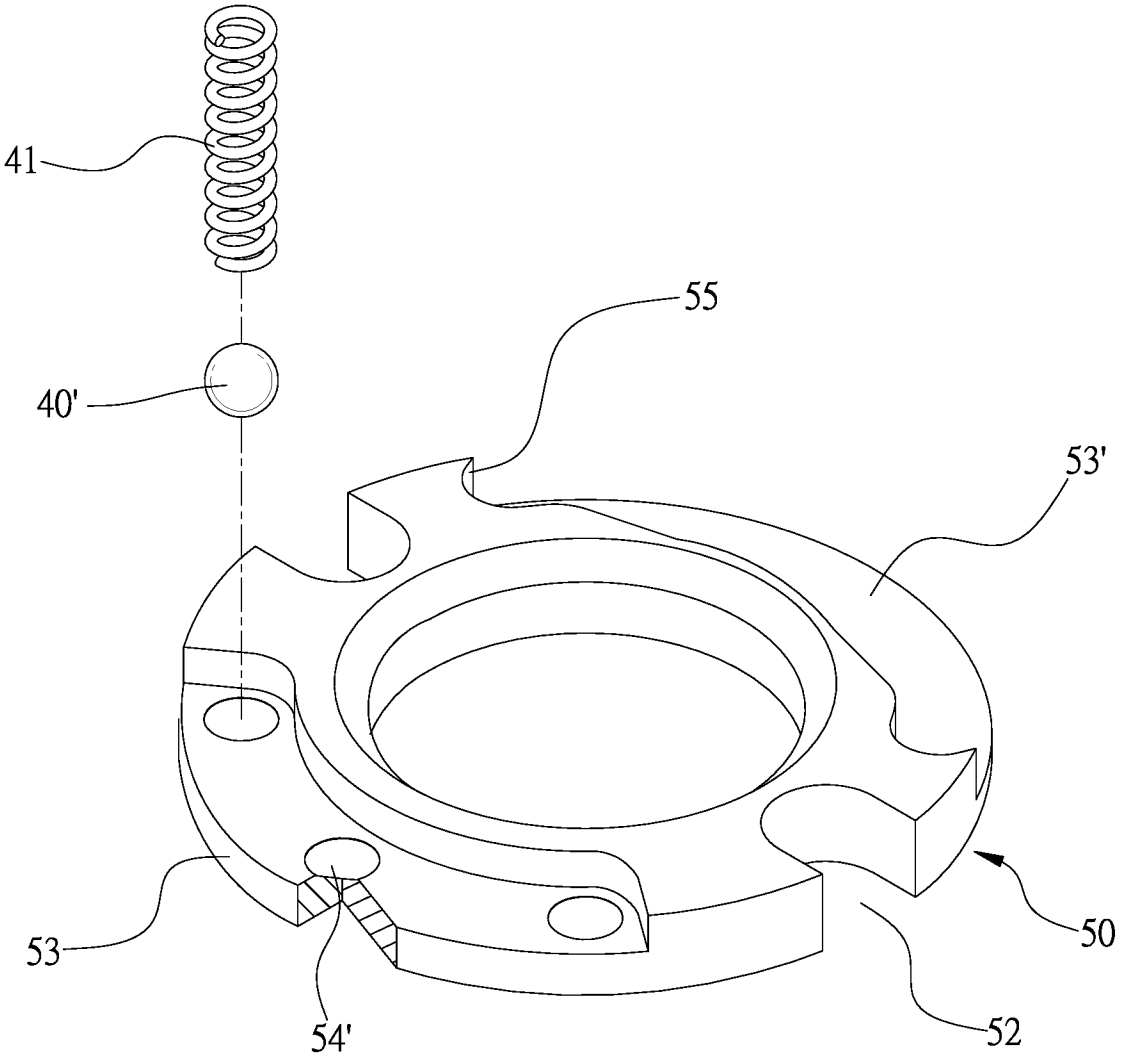
FIG. 8 is a perspective view of a ring of a ratchet screw driver according to the second embodiment of the present invention.

Referring to FIG. 8, there is shown a ring 50 of a ratchet screw driver 10 according to a second embodiment of the present invention. The second embodiment is like the first embodiment except for two things. Firstly, the ring 50 includes a thickness-reduced portion 53' in addition to the thickness-reduced portion 53. The thickness-reduced portion 53' extends between the hooks 55. An upper face of the thickness-reduced portion 53' is in contact with a lower end of the boss 44 of each of the first and second pawls 42 to keep the first and second pawls 42 in position in a longitudinal direction of the ratchet screw driver 10.

The thickness-reduced portion 53 includes three positioning recesses 54' instead of the positioning recesses 54. Each of the positioning recesses 54' includes a closed lower end.

Thirdly, the positioning element 40 is replaced with a positioning element 40' in the form of a ball.

The present invention has been described via the illustration of the embodiments. Those skilled in the art can derive variations from the embodiments without departing from the scope of the present invention. Therefore, the embodiments shall not limit the scope of the present invention defined in the claims.

The invention claimed is:

1. A ratchet screw driver comprising:

a holder comprising a wheel chamber, a ring chamber coaxial with the wheel chamber, and a pawl chamber in communication with the wheel chamber in a radial direction;

a shank comprising a toothed wheel inserted in the wheel chamber;

two pawls inserted in the pawl chamber and biased from each other, wherein each of the pawls comprises a boss and a toothed face;

a positioning element inserted in the holder;

a direction switch connected to the holder to cover the ring chamber, movable between at least two positions relative to the holder, and formed with two bosses; and a ring inserted in the ring chamber and comprising:

two cutouts for receiving the bosses of the direction switch so that the ring is rotatable with the direction switch;

a thickness-reduced portion;

at least two positioning recesses made in the thickness-reduced portion, wherein one of the positioning recesses receives the positioning element to keep the ring in one of the positions;

a wall extending along the thickness-reduced portion and comprising two bent ends for confining the positioning element so that the rotation of the ring relative to the holder is limited to a range; and two hooks, wherein one of the hooks is engaged with the boss of one of the pawls to firmly engage the toothed face of the remaining one of the pawls with the toothed wheel when the ring is moved to one of the positions by the direction switch.

2. The ratchet screw driver according to claim 1, wherein the ring comprises another thickness-reduced portion located between the hooks and in contact with the bosses of the pawls.

3. The ratchet screw driver according to claim 1, wherein the positioning element is selected from the group consisting of a pin and a ball.

4. The ratchet screw driver according to claim 1, wherein the shank comprises an axle axially extending from the toothed wheel, wherein the holder comprises an axle chamber coaxial with the wheel chamber and used to receive the axle.

5. The ratchet screw driver according to claim 4, comprising a C-clip inserted in a portion of the shank extending out of the holder through the ring and the direction switch and abutted against the direction switch.

6. A ratchet screw driver comprising:

a holder comprising a wheel chamber, a ring chamber coaxial with the wheel chamber, and a pawl chamber in communication with the wheel chamber in a radial direction;

a shank comprising a toothed wheel inserted in the wheel chamber;

two pawls inserted in the pawl chamber and biased from each other, wherein each of the pawls comprises a boss and a toothed face;

a direction switch connected to the holder to cover the ring chamber, movable between at least two positions relative to the holder, and formed with two bosses;

a ring inserted in the ring chamber and comprising:

two cutouts for receiving the bosses of the direction switch so that the ring is rotatable with the direction switch; and two hooks, wherein one of the hooks is engaged with the boss of one of the awls to firmly engage the toothed face of the remaining one of the pawls with the toothed wheel when the ring is moved to one of the positions by the direction switch; and a C-clip abutted against the ring and connected to a wall of the ring chamber to keep the ring in the ring chamber.

7. A ratchet screw driver comprising:

a handle;

a holder comprising a flat portion inserted in the handle, a wheel chamber, a ring chamber coaxial with the wheel chamber, and a pawl chamber in communication with the wheel chamber in a radial direction;

a shank comprising a toothed wheel inserted in the wheel chamber;

two pawls inserted in the pawl chamber and biased from each other, wherein each of the pawls comprises a boss and a toothed face;

a direction switch connected to the holder to cover the ring chamber, movable between at least two positions relative to the holder, and formed with two bosses; and a ring inserted in the ring chamber and comprising:

two cutouts for receiving the bosses of the direction switch so that the ring is rotatable with the direction switch; and two hooks, wherein one of the hooks is engaged with the boss of one of the awls to firmly engage the toothed face of the remaining one of the pawls with the toothed wheel when the ring is moved to one of the positions by the direction switch.

* * * * *